US007375702B2

(12) United States Patent
Yokoyama et al.

(10) Patent No.: US 7,375,702 B2
(45) Date of Patent: May 20, 2008

(54) METHOD FOR DRIVING PLASMA DISPLAY PANEL

(75) Inventors: Atsushi Yokoyama, Kawasaki (JP); Yoshikazu Kanazawa, Kawasaki (JP); Satoru Nishimura, Kawasaki (JP)

(73) Assignee: Fujitsu Hitachi Plasma Display Limited, Kawasak (JP)

( * ) Notice: Subject to any disclaimer, the term of this patent is extended or adjusted under 35 U.S.C. 154(b) by 389 days.

(21) Appl. No.: 10/355,084

(22) Filed: Jan. 31, 2003

(65) Prior Publication Data

US 2003/0218580 A1 Nov. 27, 2003

(30) Foreign Application Priority Data

May 24, 2002 (JP) ..... 2002-150605

(51) Int. Cl.
*G09G 3/10* (2006.01)
*G09G 3/28* (2006.01)

(52) U.S. Cl. ..... 345/37; 345/60

(58) Field of Classification Search ..... 345/60, 345/37, 41, 42, 55–72
See application file for complete search history.

(56) References Cited

U.S. PATENT DOCUMENTS

| | | | | |
|---|---|---|---|---|
| 6,140,984 | A | 10/2000 | Kanazawa et al. | |
| 6,369,514 | B2 * | 4/2002 | Awamoto | 315/169.1 |
| 6,373,452 | B1 | 4/2002 | Ishii et al. | |
| 6,525,486 | B2 * | 2/2003 | Awamoto et al. | 315/169.4 |
| 6,636,188 | B1 * | 10/2003 | Kanazawa et al. | 345/60 |
| 6,690,342 | B2 * | 2/2004 | Yamamoto et al. | 345/60 |
| 6,900,797 | B2 * | 5/2005 | Hirakawa et al. | 345/208 |
| 6,903,709 | B2 * | 6/2005 | Kawasaki et al. | 345/60 |
| 2002/0015012 | A1 | 2/2002 | Nakamura | |
| 2002/0105485 | A1 * | 8/2002 | Shiizaki et al. | 345/60 |
| 2002/0135545 | A1 * | 9/2002 | Akiba | 345/60 |
| 2002/0190930 | A1 * | 12/2002 | Shiizaki et al. | 345/63 |

FOREIGN PATENT DOCUMENTS

| | | |
|---|---|---|
| JP | 10-39834 | 2/1998 |
| JP | 2001-13915 | 1/2001 |

OTHER PUBLICATIONS

Search Report in corresponding European Application No. 03250683 dated Dec. 12, 2006.

* cited by examiner

*Primary Examiner*—Sumati Lefkowitz
*Assistant Examiner*—Srilakshmi K Kumar
(74) *Attorney, Agent, or Firm*—Staas & Halsey LLP

(57) ABSTRACT

A method for driving a PDP is disclosed, and is capable of suppressing an erroneous discharge during an address discharge and sustain discharge and of preventing deterioration in image quality, comprising: a reset period for initialization; an address period having a first half of the address period in which one of odd-numbered and even-numbered second electrodes are first scanned sequentially, and address pulses are applied to third electrodes, and a subsequent second half of the address period in which others of the odd-numbered and the even-numbered second electrodes are scanned sequentially, and address pulses are applied to the third electrodes; and a sustain discharge period in which sustain discharges are caused to occur, wherein the potential difference between the second electrode and the third electrode in the second half of the address period is set to a value larger than the potential difference between the second electrode and the third electrode in the first half of the address electrode.

8 Claims, 11 Drawing Sheets

METHOD FOR DRIVING PLASMA DISPLAY PANEL

BACKGROUND OF THE INVENTION

The present invention relates to a plasma method for driving a plasma display panel. More particularly, the present invention relates to a method for driving an AC-driven plasma display panel (referred to as an AC-driven PDP hereinafter) that has a three-electrode structure and performs memory display.

FIG. 1 is a diagram that shows the general structure of an AC-driven PDP.

A PDP 1 comprises a pair of substrates arranged opposite to each other and a discharge gas sealed therebetween. On one of the substrates, sustain electrodes (X1 to X3) and scan electrodes (Y1 to Y3) arranged in parallel to each other are provided, and on the other substrate, address electrodes (A1 to A4) arranged in the direction perpendicular to the sustain electrodes and the scan electrodes and partitions 2 arranged in parallel to the address electrodes to define a discharge space are provided. Although only the three sustain electrodes, three scan electrodes and four address electrodes are shown in FIG. 1 for simplicity, many electrodes are actually used according to the resolution of the PDP 1.

A display line L is formed between a sustain electrode and a scan electrode adjacent to each other. In the example in FIG. 1, the X1 electrode and the Y1 electrode form a display line L1, the X2 electrode and the Y2 electrode form a display line L2, and the X3 electrode and the Y3 electrode form a display line 3. On the other hand, adjacent pairs of the sustain electrode and the scan electrode that form the display lines form a non-display line therebetween. In the example in FIG. 1, the non-display lines are formed between the Y1 electrode and the X2 electrode, and between the Y2 electrode and the X3 electrode. In order to prevent an erroneous discharge from occurring in the adjacent display lines L1 to L3, the interval between neighboring electrodes that form a non-display line is made wider than the interval between neighboring electrodes that form a display line. Moreover, a discharge cell is formed in an area defined by a pair of the neighboring sustain electrode and the scan electrode and the address electrode that is perpendicular thereto, and a phosphor is provided in the discharge cell in order to obtain visible light.

FIG. 2 is a block diagram that shows the general structure of the PDP apparatus shown in FIG. 5.

The PDP apparatus in FIG. 2 comprises the PDP 1, a data (address) driver 22, a sustain driver 23, a first (odd-numbered) scan driver 24*a*, a second (even-numbered) scan driver 24*b*, a scan pulse generation circuit 25 and an interface circuit 26 (for example, refer to Japanese Unexamined Patent Publication (Kokai) No. 10-39834).

The display data and the control signal from the outside of the apparatus are converted properly in the interface circuit 26 and supplied to the data (address) driver 22, the sustain driver 23, the first (odd-numbered) scan driver 24*a* and the second (even-numbered) scan driver 24*b*. The scan pulse and the sustain pulse to be applied to the scan electrode Y are generated in the scan pulse generation circuit 25 and their timings are controlled in the first (odd-numbered) scan driver 24*a* and the second (even-numbered) scan driver 24*b* by the signal from the interface circuit 26.

Similarly, the sustain pulse and the erasure pulse to be applied to the sustain electrode X are generated in the sustain driver 23 while being controlled by the interface circuit 26.

A description about a method for driving the above-mentioned AC-driven PDP is given below with reference to drawings.

A gradated display in the PDP 1 shown in FIG. 1 is performed by using the subfield driving method in which a frame is divided into a plurality of subfields and driven.

FIG. 3 is a diagram that shows the structure of a field in the PDP shown in FIG. 1. FIG. 3 shows an example of the subfield driving method in which a field is divided into eight subfields SF1 to SF8 for a gradated display. The luminance of each field is weighted by two to the n-th power and it is possible to perform a gradated display of any level by combining proper subfields.

In this method, each subfield is divided into a write period (address period), a sustain discharge period and an erasure period (reset period).

FIG. 4 is a diagram that shows the waveforms that illustrate the method for driving the PDP shown in FIG. 1. FIG. 4 shows the waveforms at the address electrode, the sustain electrodes X1 to Xn and the scan electrodes Y1 to Yn in an arbitrary subfield in a field, and each subfield is composed of the write period (address period), the sustain discharge period and the erasure period (reset period). When the scan electrode is scanned and display data is written during the write discharge period (address period), subsequent scanning is performed not to the next but the following scan electrode so that a write discharge (address discharge) is prevented from being caused to occur in the adjacent pixel successively with respect to time, and all the discharges are maintained at a time in the sustain discharge period for a light emitted display (for example, refer to Japanese Unexamined Patent Publication (Kokai) No. 2001-13915).

As shown in FIG. 4, in the write action (addressing) in the first half of the write period (address period), a voltage Vx is applied to the odd-numbered X electrodes X1, X3, . . . , a voltage 0V is applied to the even-numbered X electrodes X2, X4, . . . , and a scan pulse voltage −Vsc is applied to the odd-numbered Y electrodes Y1, Y3, . . . At this time, the voltage 0V is applied to the even-numbered Y electrodes. In concurrence with this, an address pulse having a voltage Va is applied selectively to the address electrode and a first discharge is caused to occur between the address electrode and the Y electrode in the selected cell in the odd-numbered display lines (L1, L3, . . . ) to be lit. Then with this discharge serving as a priming, a second discharge is immediately caused to occur between the X electrode and the Y electrode. "Address discharge" is a general term for the first discharge and the second discharge. Due to this, wall charges that enable a sustain discharge to occur are accumulated on the X electrode and the Y electrode in the selected cell in the odd-numbered display lines. When the above action is performed as far as the last odd-numbered Y electrode (Yn−1), the writing (addressing) of the selected cells in the odd-numbered display lines is completed in the first half of the write address (address period).

Next, in the second half of the write period (address period), the voltage Vx is applied to the even-numbered X electrodes X2, X4, . . . , the voltage 0V is applied to the odd-numbered X electrodes Y1, Y3, . . . , and the scan pulse voltage −Vsc is applied to the even-numbered Y electrodes Y2, Y4, . . . , sequentially. In this way, the writing (addressing) of the selected cells in the even-numbered display lines is completed. As described above, the writing (addressing) of the selected cells in all of the display lines is completed in the first half and the second half of the write period (address period).

In the next sustain discharge period, a sustain pulse having a (alternating) voltage Vs is applied alternately to the Y electrode and the X electrode, a sustain discharge is caused to occur (only in the selected cells in the display lines in which the address discharge has been formed) according to the wall charges written (addressed) during the write period, as described above, and the image of a subfield in a field is displayed.

In the erasure period (reset period), an erasure pulse voltage VB is applied to all the sustain electrodes (X1 to Xn) to cause an erasure discharge to occur and the wall charges in the (lit) cells in the display lines, in which the sustain discharge has been caused to occur in the previous sustain period, are reduced or erased.

However, in the driving method described above, the address discharge is weak in the skipped display lines (even-numbered lines in this case). As a result, a problem occurs that the light emitted display in the display line flickers or the lines appear dim.

Concerning this problem, a description is given below with reference to FIG. 4 and FIG. 5.

FIG. 5 is a diagram that shows how an address discharge is caused to occur when the driving method described in FIG. 4 is applied to the PDP shown in FIG. 1. For simplicity, only four sustain discharge electrodes and four scan electrodes are shown and the X1 electrode and the Y1 electrode form the display line L1, the X2 electrode and the Y2 electrode form the display line L2, the X3 electrode and the Y3 electrode form the display line L3, and the X4 electrode and the Y4 electrode form the display line L4 as shown schematically.

As described above, in the first half of the write period (address period), the first discharge is caused to occur between the address electrode and the Y electrode (Y1 and Y3) in the selected cell in the odd-numbered display lines (L1 and L3) to be lit, and with the first discharge serving as a priming, the second discharge is immediately caused to occur between the scan electrode Y and the sustain electrode X (between the X1 and the Y1 electrodes, and between the X3 and the Y3 electrodes).

However, as the above-mentioned address discharge propagates while extending along the address electrode, it may happen that an erroneous discharge (referred to as a first erroneous discharge hereinafter) is caused to occur in the X electrode (X2) in the adjacent display line L2 adjacent to the Y1 electrode during the period of the address discharge in the odd-numbered line L1 in the first half of the write period (address period), as shown by the dotted line in the figure.

As a result, the address discharge during the scanning of the even-numbered line L2 in the second half of the write period (address period), which follows the scanning of the odd-numbered line L1 in the first half of the write period (address period), becomes weak and unstable, therefore, a problem occurs that the light emitted display of the display line (the even-numbered line L2) in the subsequent sustain discharge period flickers or the line appears dim.

The reason may be that the wall charges, which tend to decrease the potential of the sustain electrode X2 with respect to the scan electrode Y2 and the address electrode, are formed on the sustain electrode X2 due to the erroneous discharge (the first erroneous discharge), the voltage between the scan electrode Y2 and the sustain electrode X2 in the even-numbered line L2 is reduced, and the address discharge during the scanning of the even-numbered line L2 becomes weaker than the address discharge during the scanning of the odd-numbered line L1.

In Japanese Unexamined Patent Publication (Kokai) No. 2001-13915, a driving method has been proposed, as an improved method for driving an AC-driven PDP, in which the above-mentioned problems have been solved, the object of which is to stabilize the address discharge in the second half of the write period (address period) by increasing the voltage to be applied to the sustain electrode in the second half of the write period (address period) to recover the internal voltage that has been lowered due to the excessive wall charges caused to form by the erroneous discharge in the first half of the write period (address period), using a driving method in which either one of the odd-numbered lines and the even-numbered lines are scanned in the first half of the write period (address period) and the others are scanned in the second half of the write period (address period).

FIG. 6 is a diagram that shows the waveforms illustrating the method for driving the PDP shown in FIG. 1. FIG. 6 shows the driving method disclosed in Japanese Unexamined Patent Publication (Kokai) No. 2001-13915, described above, wherein a voltage Vy to be applied to the sustain electrodes (X2, X4, . . . ) during the scanning of the even-lines in the second half of the write period (address period) is set to a value larger than the voltage Vx (Vx<Vy) to be applied to the sustain electrodes (X1, X3, . . . ) during the scanning of the odd-numbered lines in the first half of the write period (address period).

As described above, when the scanning of the odd-numbered lines and the even-numbered lines is performed separately in the first half and the second half of the write period (address period), it is possible to compensate for the amount of decrease in the potential of the sustain electrodes (X2, X4, . . . ) due to the wall charges formed on the sustain electrodes (X2, X4, . . . ) in the even-numbered lines by the erroneous discharge of the address discharge during the scanning of the odd-numbered lines in the first half of the write period (address period) by increasing the potential of the sustain electrode X with respect to the scan electrode Y and the address electrode. In this way, the address discharge can stably be caused to occur during the scanning of the even-numbered lines.

FIG. 7 is a diagram that shows how the address discharge is caused to occur when the driving method described in FIG. 6 is applied to the PDP shown in FIG. 1.

As described above, the voltage Vy to be applied to the X2 electrode during the scanning of the even-numbered line L2 in the second half of the write period (address period) becomes larger than the voltage Vx to be applied to the X1 and X3 electrodes during the scanning of the odd-numbered lines L1 and L3 in the first half of the address period (Vx<Vy), therefore, the potential difference Vy+Vs between the X2 and Y2 electrodes in the even-numbered line L2 becomes larger than the potential difference Vx+Vs between the X1 and Y1 electrodes in the odd-numbered display line L1 and between the X3 and Y3 electrodes in the odd-numbered display line L3 (Vx+Vs<Vy+Vs). Due to this, the scale of the address discharge in the even-numbered line L2 becomes greater than that in the odd-numbered line L1 (by the amount of the potential difference Vy−Vx>0).

As a result, when the sustain discharge is caused to occur in the subsequent sustain discharge period, the scale of the sustain discharge in the even-numbered line L2 is increased by the alternating sustain pulse voltage Vs to be applied to cause the sustain discharge to occur in the selected cells in all of the display lines, and the discharge propagates to the odd-numbered line L3 adjacent to the Y2 electrode in the even-numbered line L2, as shown in FIG. 7 (a second erroneous discharge is caused to occur). This is because the wall charges, which tend to decrease the potential of the sustain electrode X3 with respect to the scan electrode Y3 and the address electrode, are formed on the sustain electrode X3 in the odd-numbered line L3 due to the second erroneous discharge, as is the same in the first erroneous discharge described above, the voltage between the scan electrode Y3 and the sustain electrode X3 in the even-numbered line L3 is reduced, and the sustain discharge in the even-numbered line L3 becomes weak and unstable. As a result, a problem occurs that the light emitted display in the display line flickers or the line appears dim.

SUMMARY OF THE INVENTION

The object of the present invention is to solve the above-mentioned problems and to provide a method for driving a PDP, thereby the (the first and second) erroneous discharges during the period of an address discharge and sustain discharge can be suppressed from occurring and the deterioration of the image quality can be prevented.

In the present invention, the method for driving a plasma display panel, in which a plurality of first and second electrodes in parallel to each other are arranged adjacently by turns, a plurality of third electrodes are arranged in the direction perpendicular to that of the first and second electrodes, and discharge cells defined at the crossings of each electrode are arranged in a matrix, comprises: a reset period in which the distribution of the wall charges in the plurality of discharge cells is initialized; an address period to form a distribution of wall charges in accordance with display data, having a first half of the address period in which ones of the odd-numbered second electrodes and the even-numbered second electrodes are first scanned sequentially and address pulses in accordance with the display data are applied to the third electrodes, and a second half of the address period in which others of the second electrodes, that is, the odd-numbered second electrodes or the even-numbered second electrodes that have not been scanned in the first half of the address period, are then scanned sequentially and the address pulses in accordance with the display data are applied to the third electrodes; and a sustain discharge period in which sustain discharges are caused to occur according to the distribution of the wall charges formed during the address period, wherein the potential difference between the second electrode and the third electrode during the second half of the address period is made larger than the potential difference between the second electrode and the third electrode during the first half of the address period.

According to the method for driving a plasma display panel of the present invention, a driving method is used in which either odd-numbered lines or even-numbered lines are scanned during the first half of the address period and the rest are scanned during the second half of the address period, and it is possible to recover the internal voltage of the discharge cell reduced by the excessive wall charges due to the erroneous discharges (the first and second erroneous discharges) during the first half of the address period and to cause the address discharge to occur stably during the second half of the address period by making the potential difference between the second electrode and the third electrode during the scanning of the odd-numbered lines in the first half of the address period larger than that during the scanning of the even-numbered lines during the second half of the address period and, simultaneously, it is also possible to stably cause the sustain discharge to occur without fail in every display line during the sustain discharge period by making the potential difference between the first electrode and the second electrode, during the scanning of the odd-numbered lines, equal to that during the scanning of the even-numbered lines so that the wall charges required to start the subsequent sustain discharge in the odd-numbered lines and those in the even-numbered lines are equal to each other at the end of the first half and the second half of the address periods.

BRIEF DESCRIPTION OF THE DRAWINGS

The features and advantages of the invention will be more clearly understood from the following description taken in conjunction with the accompanying drawings in which.

DESCRIPTION OF THE PREFERRED EMBODIMENTS

A description of the methods for driving an AC-driven PDP in the embodiments of the present invention is given below with reference to drawings.

Figure 8:
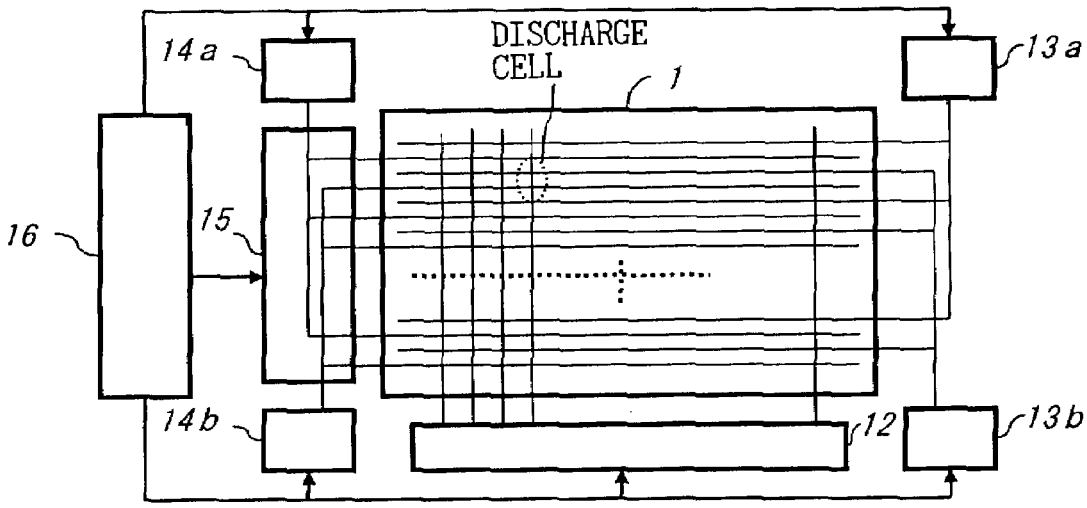
FIG. 8 is a block diagram that shows the general structure of an AC-driven PDP in embodiments of the present invention.

FIG. 8 is a block diagram that shows the general structure of an AC-driven PDP in the embodiments of the present invention.

As shown in FIG. 8, the PDP apparatus comprises the PDP 1, an address driver 12, an odd-numbered X sustain circuit 13*a*, an even-numbered X sustain circuit 13*b*, an odd-numbered Y sustain circuit 14*a*, an even-numbered Y sustain circuit 14*b*, a scan driver 15 and a control circuit 16.

As shown in FIG. 8, each address electrode is connected to the address driver 12 and supplied with an address pulse for the address discharge from the address driver 12. Each Y electrode is connected to the scan driver 15. The scan driver 15 is divided into two parts, one for driving odd-numbered Y electrodes Y, Y3, . . . , and the other for driving even-numbered Y electrodes Y2, Y4, . . . , both being connected to the odd-numbered Y sustain circuit 14*a* and the even-numbered Y sustain circuit 14*b*, respectively. The pulses for addressing are generated in the scan driver 15, the sustain discharge pulses are generated in the odd-numbered Y sustain circuit 14*a* and the even-numbered Y sustain circuit 14*b*, and supplied to each Y electrode via the scan driver 15. The X electrodes X1, X2, . . . , are divided into two groups, one group including the odd-numbered X electrodes X1, X3, . . . , and the other including the even-numbered X electrodes X2, X4, . . . , and both groups are connected to the odd-numbered X sustain circuit 13*a* and the even-numbered X sustain circuit 13*b*, respectively. These driver circuits are controlled by the control circuit 16, and the control circuit is controlled by the synchronization signals or display data signals entered from the outside of the apparatus.

Figure 9A:
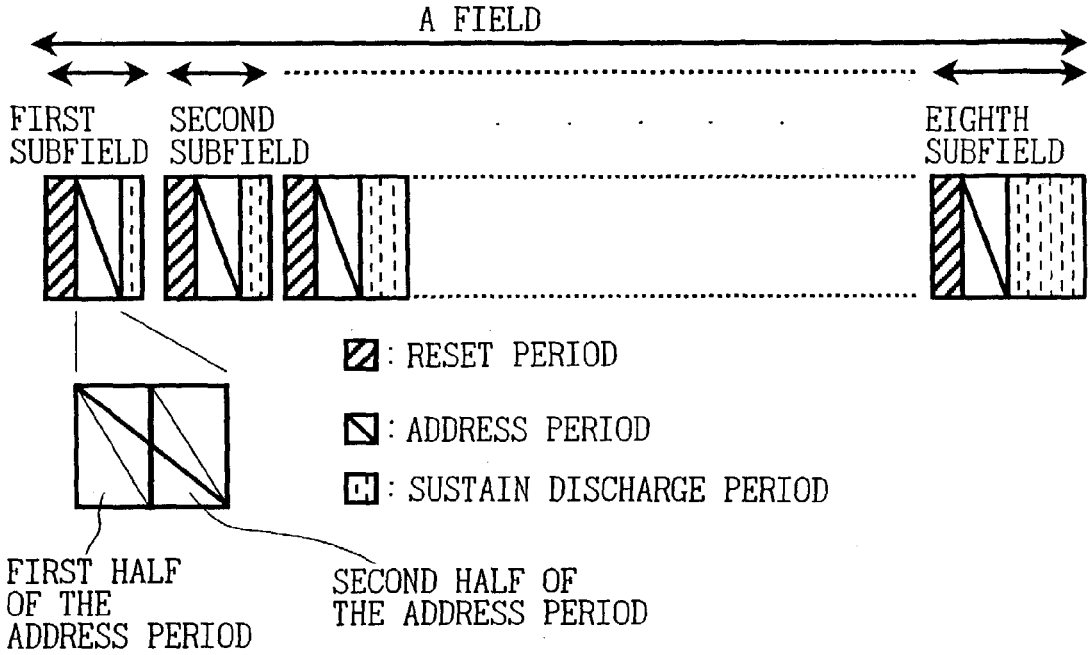
FIG. 9A and FIG. 9B are diagrams that show the structures of frames in the embodiments of the present invention.
Figure 9B:
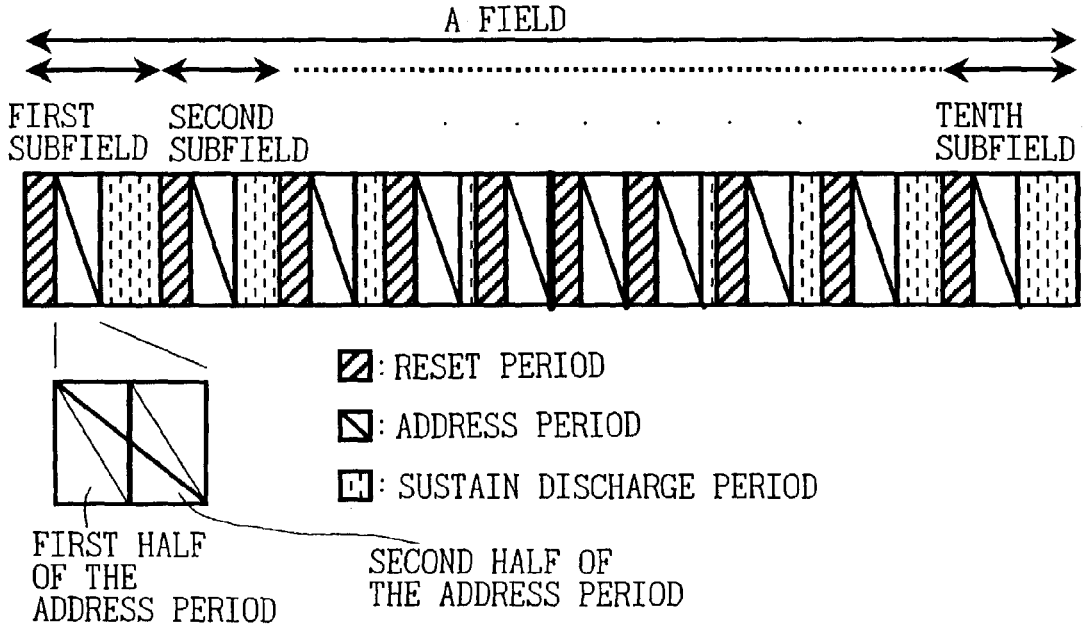

FIG. 9A and FIG. 9B are diagrams that show the structures of frames in the embodiments of the present invention.

As each display cell in the PDP has only two values, the on-state and the off-state, the shades of brightness, that is, the gradation is expressed by the number of times of light emission.

As shown schematically, a field is divided into eight or 10 subfields. Each subfield comprises a reset period, a first half and a second half of the address period, and a sustain discharge period. In the reset period, all the cells are reset to their initial state, for example, a state in which wall charges are erased, regardless of the state of being lit or unlit in the previous subfield. In the (first half and the second half of the) address period, as the on-state or the off-state is determined according to the display data, selective discharges (address discharges) are caused to occur and the wall charges that turn the cells into the on-state are formed. In the sustain discharge period, discharges are repeated in the cells in which the address discharge has been caused to occur and fixed light is emitted. The length of the sustain discharge period, that is, the number of times of light emission differs from subfield to subfield. For example, by setting the ratio of times of light emission in the first subfield to the eighth subfield to 1:2:4:8: . . . :64:128, as shown in FIG. 2A, and by selecting subfields to cause a discharge to occur according to the luminance of the cell for display, a gradated display of any level can be obtained.

Figure 1:
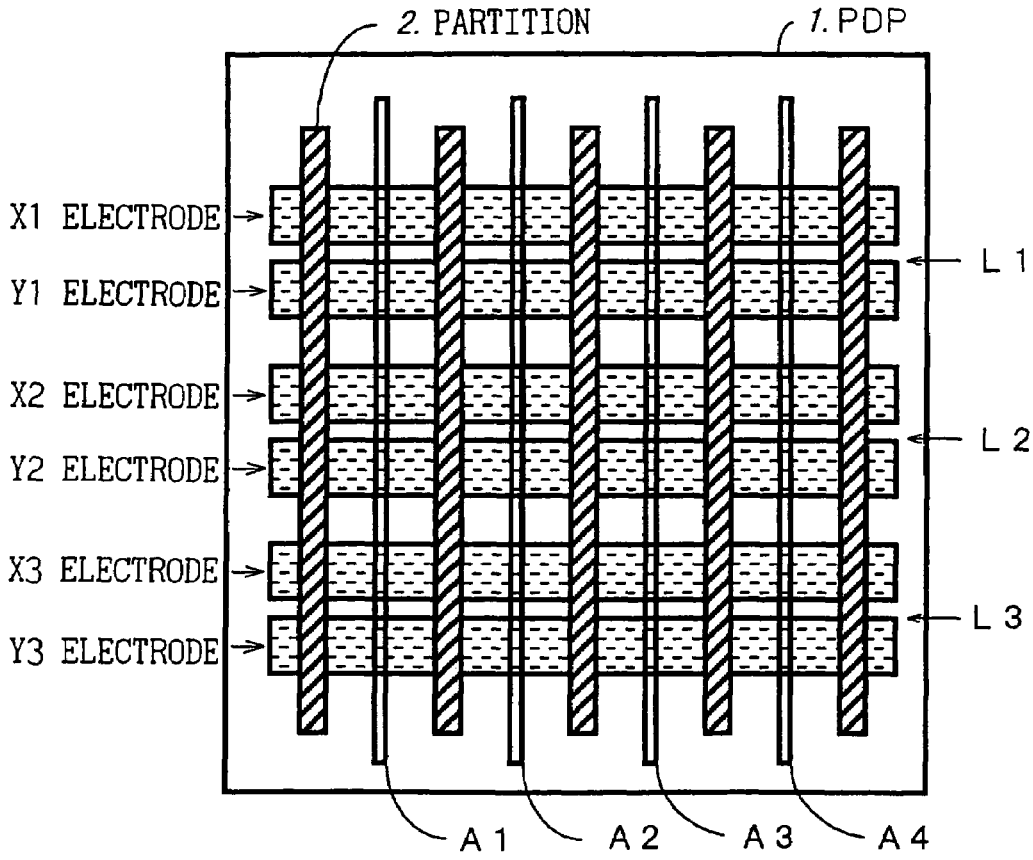
PRIOR ART FIG. 1
FIG. 1 is a diagram that shows the general structure of an AC-driven PDP.
Figure 2:
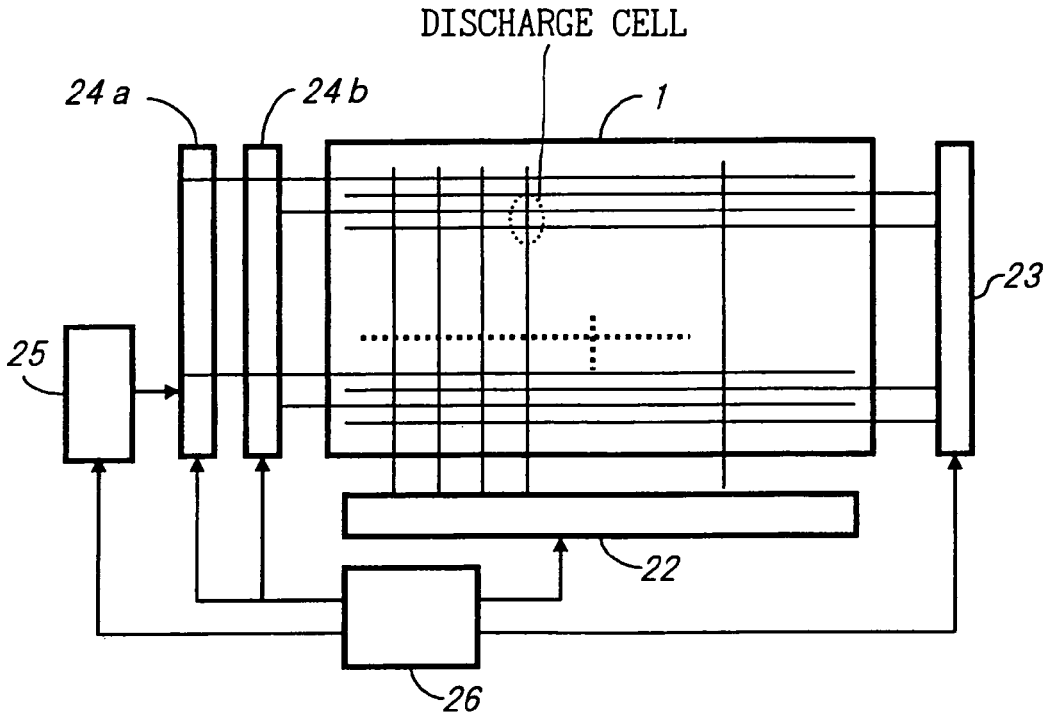
PRIOR ART FIG. 2
FIG. 2 is a block diagram that shows the general structure of the PDP apparatus shown in FIG. 1.
Figure 3:
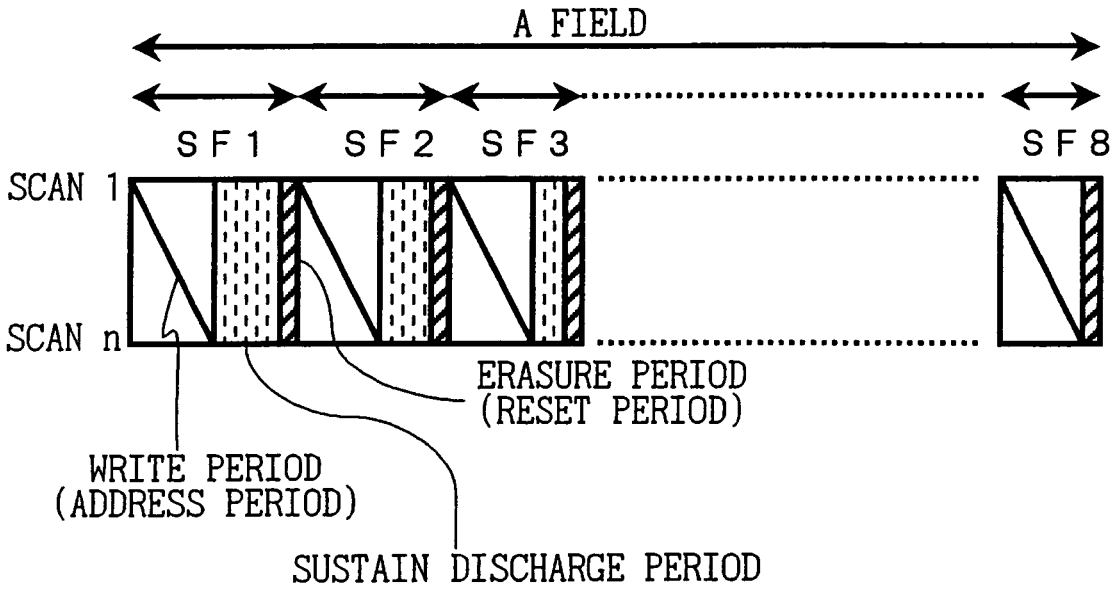
PRIOR ART FIG. 3
FIG. 3 is a diagram that shows the structure of a frame of the PDP shown in FIG. 1.
Figure 4:
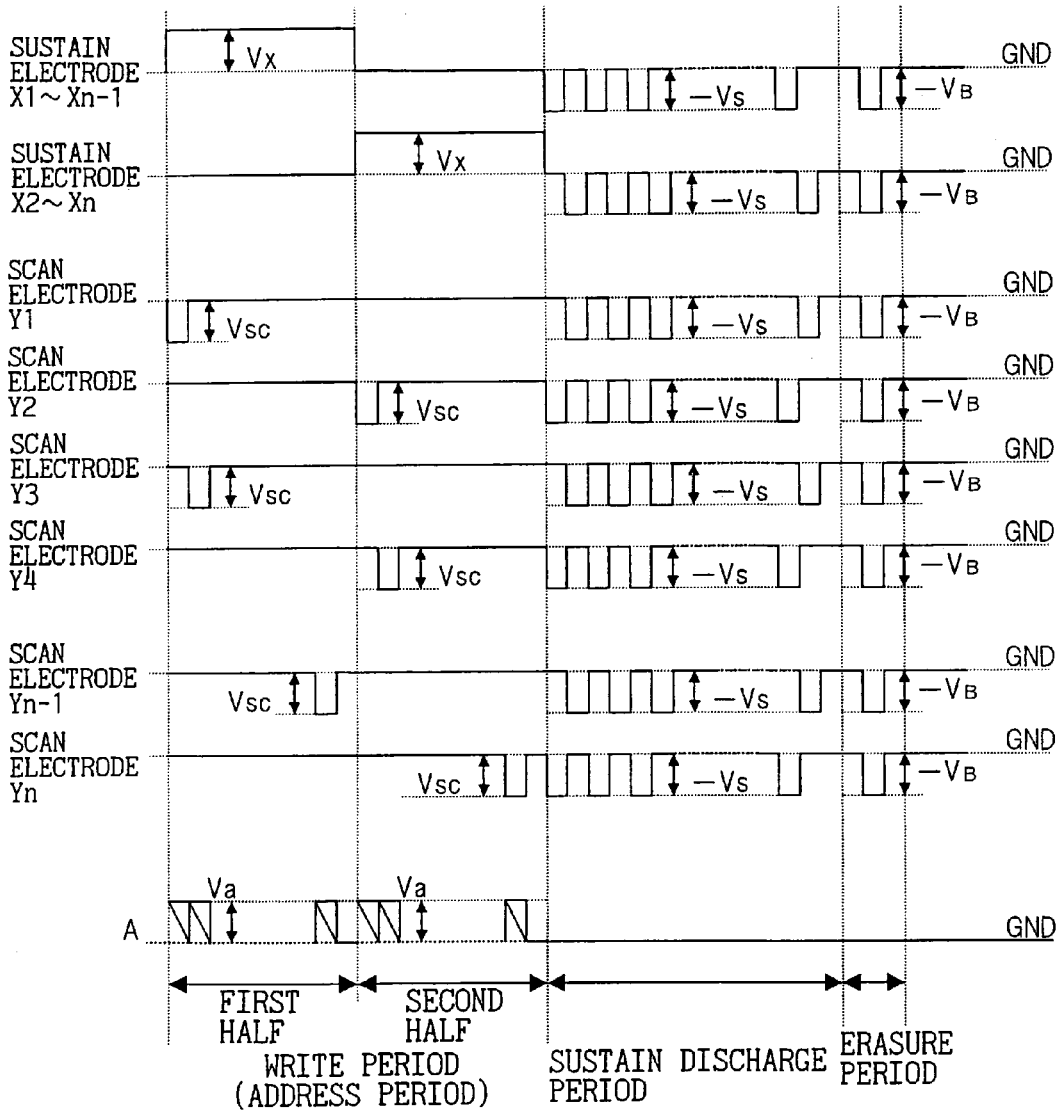
PRIOR ART FIG. 4
FIG. 4 shows first waveforms that illustrate a method for driving the PDP shown in FIG. 1.
Figure 5:
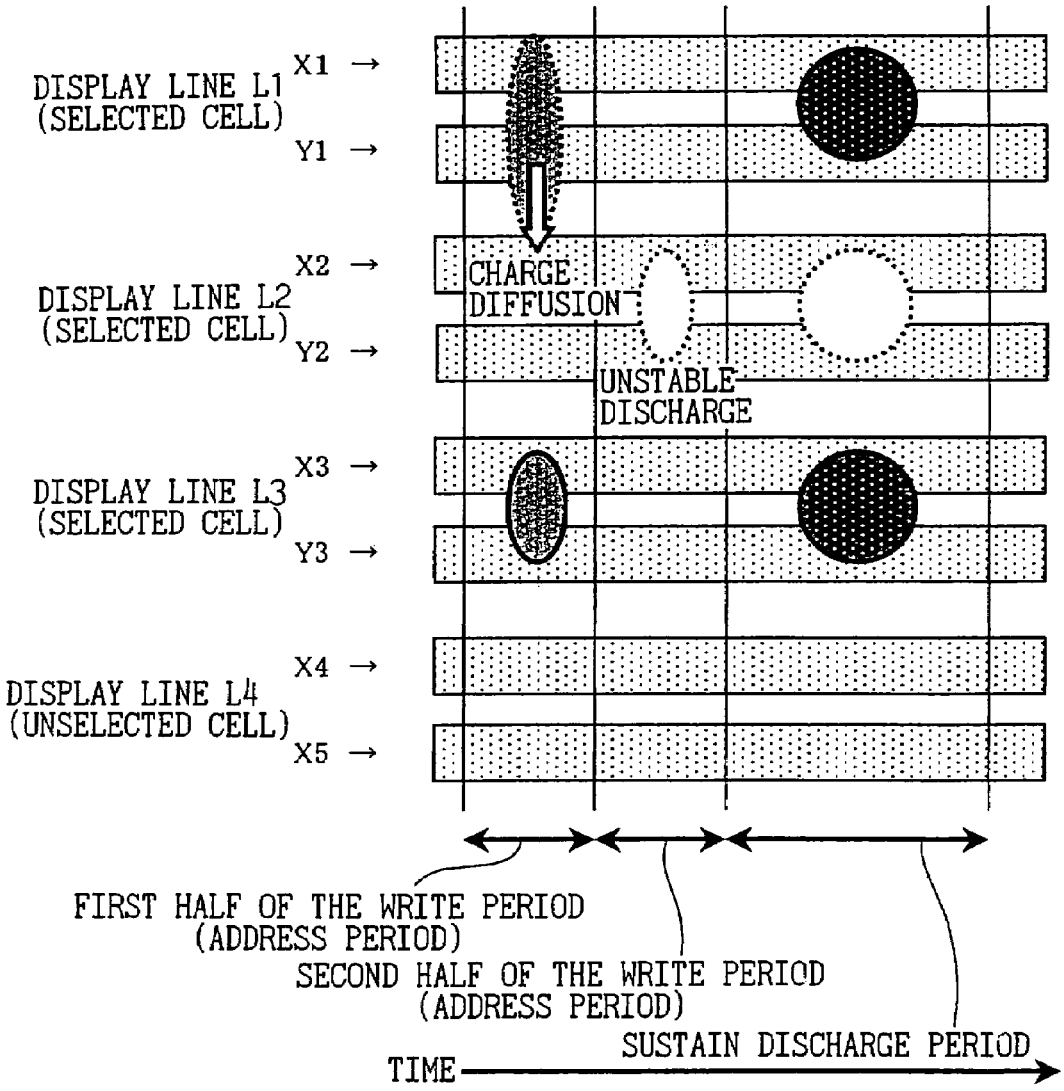
PRIOR ART FIG. 5
FIG. 5 is a diagram that shows how address discharges occur when a driving method described in FIG. 8 is applied to the PDP shown in FIG. 1.
Figure 6:
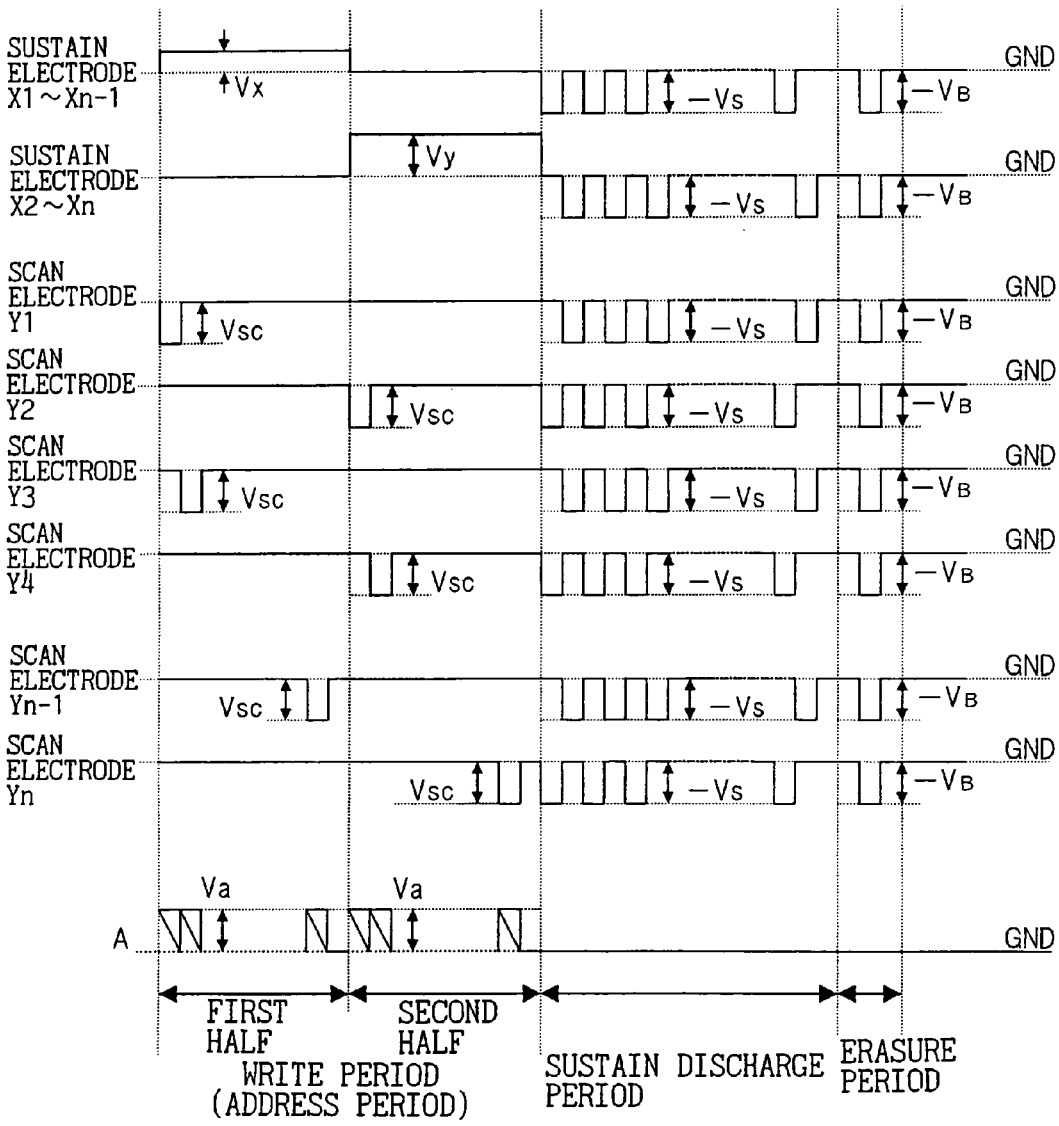
PRIOR ART FIG. 6
FIG. 6 shows second waveforms that illustrate a method for driving the PDP shown in FIG. 1.
Figure 7:
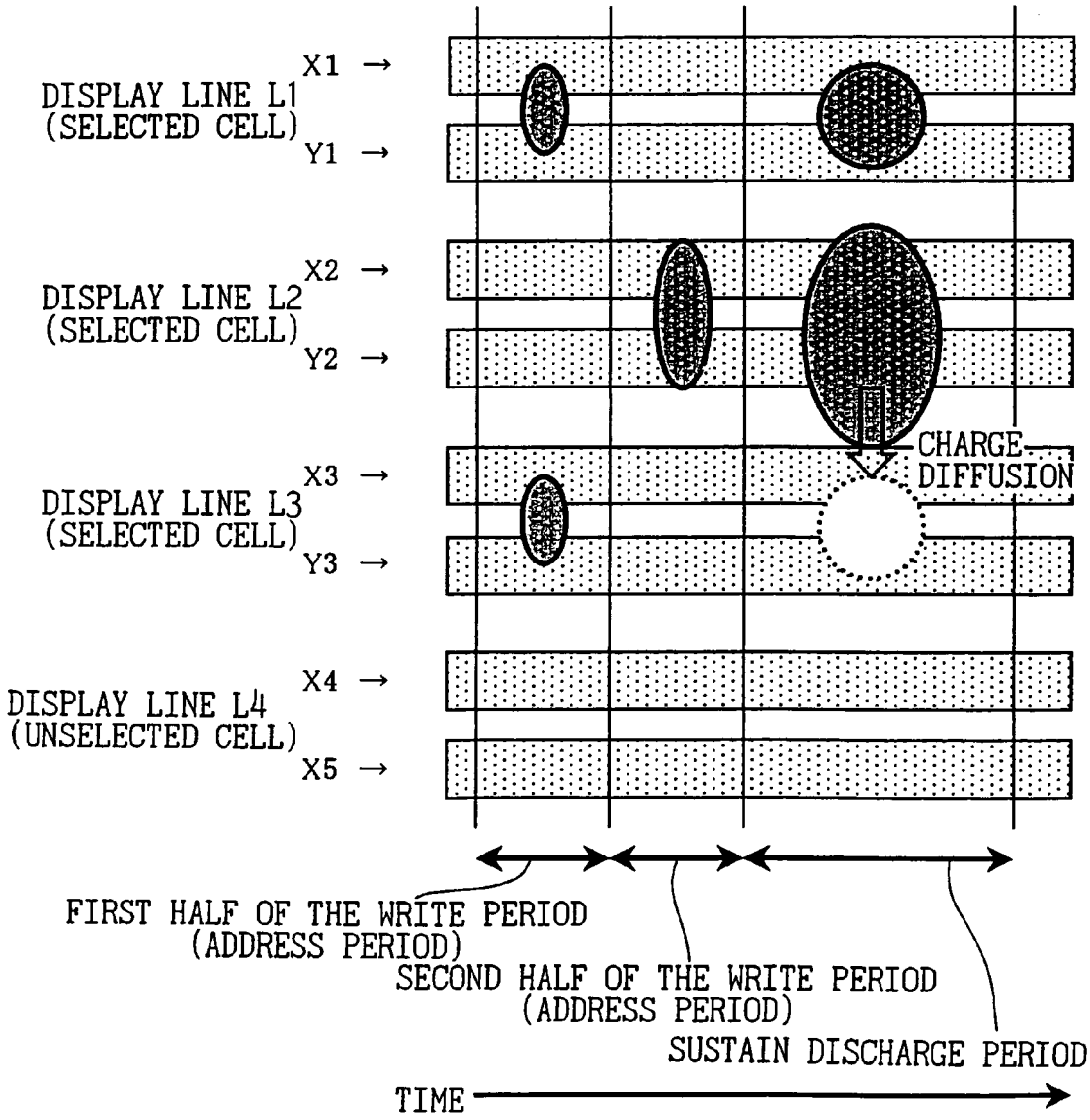
PRIOR ART FIG.7
FIG. 7 is a diagram that shows how address discharges occur when a driving method described in FIG. 10 is applied to the PDP shown in FIG. 1.

Moreover, the structure of the subfield shown in FIG. 2B is, for example, a structure to control the occurrence of a color false contour disclosed in Japanese Unexamined Patent Publication (Kokai) No. 9-311662, in which the ratio of times of light emission in the first subfield to the tenth subfield is set to 20:12:8:4:1:2:4:8:12:20, as shown schematically. By combining these subfields, 92 gradation levels (in total), that is, from 0 to 91, can be expressed. As there are equally weighted subfields in pairs, there are a plurality of combinations for an identical gradation level, and the combinations can be switched.

Figure 10:
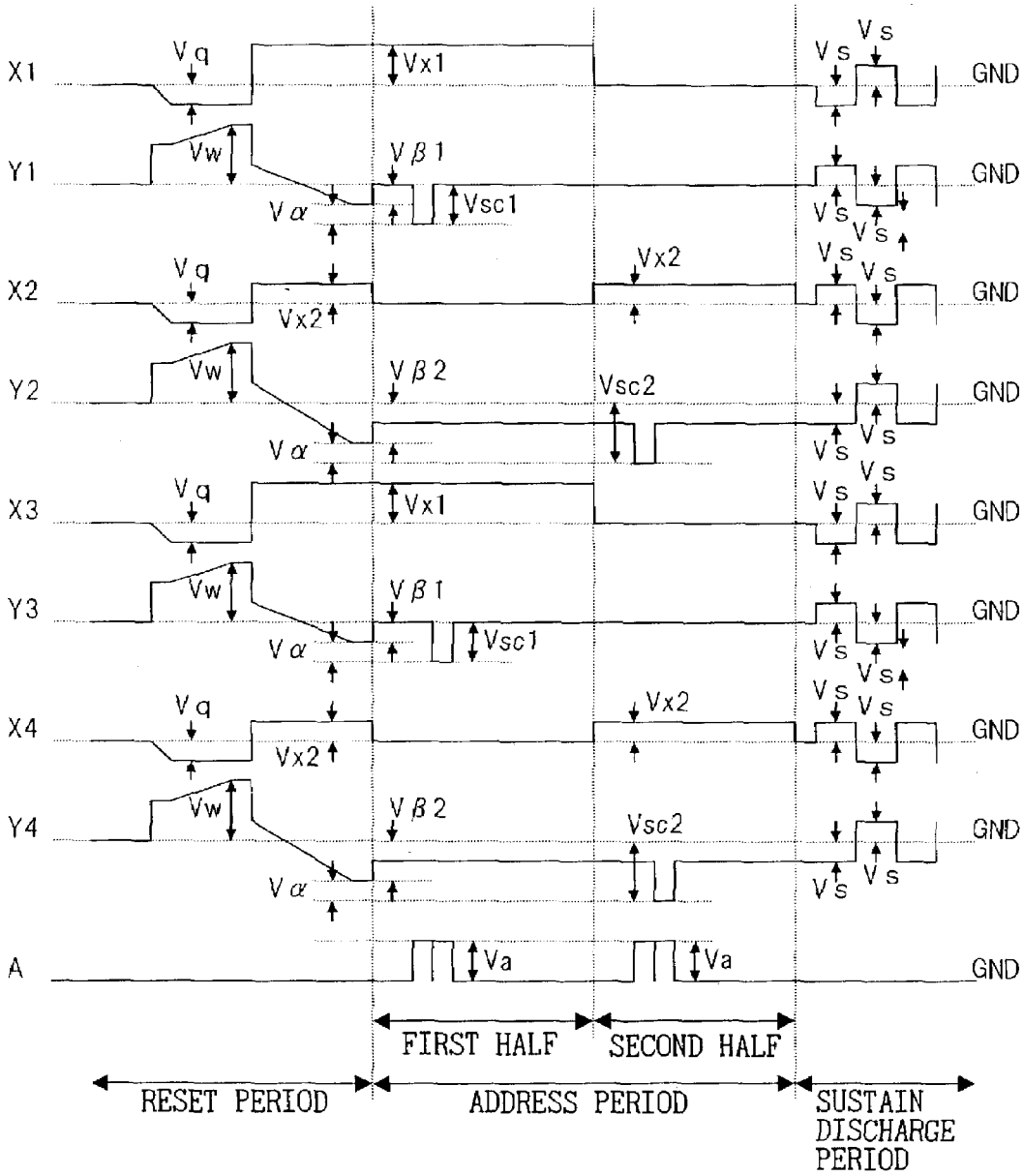
FIG. 10 shows waveforms that illustrate a method for driving an AC-driven PDP in a first embodiment of the present invention.

FIG. 10 shows the waveforms that illustrate the method for driving an AC-driven PDP in the first embodiment of the present invention.

FIG. 10 shows a driving method in a subfield, and waveforms in the address (A) electrodes, the sustain electrodes X1 to X4 and the scan electrodes Y1 to Y4 in an arbitrary subfield in a field where the display in the odd-numbered lines and even-numbered lines is performed.

First, as shown in FIG. 10, in the reset action in the first half of the reset period, while all the address electrodes are kept at 0 (V) by the address driver 12, a negative pulse and a positive pulse are applied to every sustain electrode X and scan electrode Y, respectively. In other words, a pulse having a voltage −Vq is supplied to every sustain electrode X from the odd-numbered X sustain circuit 13*a* and the even-numbered X sustain circuit 13*b*, and at the same time a pulse having a voltage Vw is applied to every scan electrode Y from the odd-numbered Y sustain circuit 14*a* and the even-numbered Y sustain circuit 14*b* (via the scan driver 15). The pulse to be applied at this time to the scan electrode Y is an obtuse pulse in which the voltage gradually changes until the voltage reaches Vw. In this way, a first weak discharge is caused to occur between the sustain electrode X and the scan electrode Y in every odd-numbered and even-numbered line.

If, for example, a voltage Vw having a rectangular waveform is applied to cause the first discharge to occur, a strong discharge according to the difference (Vw−Vf) between the applied voltage Vw and the discharge start voltage (Vf) in a discharge cell is caused to occur, and the background luminance is increased, resulting in deterioration in contrast. Moreover, due to the strong discharge, excessive wall charges are formed and an erroneous discharge is caused to occur, affecting the neighboring discharge cells. However, if an obtuse pulse is used as is in the present embodiment, each discharge cell starts a discharge when the applied voltage exceeds the discharge start voltage Vf in each discharge cell, therefore, the discharge caused to occur is weak, the amount of emitted light is small, and a significant deterioration in contrast can be avoided. Moreover, the amount of the wall charges formed by the weak discharge is very small. As a result, even if the first discharge is caused to occur in a discharge cell, it does not affect the neighboring discharge cells. Moreover, as the discharge is weak, the amount of the background light emission is small and a significant deterioration in contrast can be avoided.

Similarly, in the subsequent resetting in the second half of the reset period, while all the address electrodes are kept being 0 (V) by the address driver 12, a pulse having a voltage Vx1 is applied to every odd-numbered X electrode from the odd-numbered X sustain circuit 13*a* and a pulse having a voltage Vx2 is applied to every even-numbered X electrode from the even-numbered X sustain circuit 13*b*, and at the same time, a pulse having a voltage −Vβ1 is applied to every odd-numbered Y electrode and a pulse having a voltage −Vβ2 is applied to every even-numbered Y electrode. At this time, an obtuse pulse in which the amount of change in voltage per unit time keeps changing until the voltage reaches −Vβ1 is applied to every odd-numbered Y electrode from the odd-numbered Y sustain circuit 14*a* (via the scan driver 15), and an obtuse pulse in which the amount of change in voltage per unit time keeps changing until the voltage reaches −Vβ2 is applied to every even-numbered Y electrode from the even-numbered Y sustain circuit 14*b* (via the scan driver 15). In this way, a second discharge is caused to occur between the sustain electrode X and the scan electrode Y in every odd-numbered and even-numbered line, and the wall charges formed by the above-mentioned first discharge are erased. Due to the (second) discharge, the amount of the wall charges is so adjusted as to be optimum for the subsequent address discharge, and it is possible to make the effective discharge start voltage uniform, including the wall charges in the discharge cell in all of the display lines.

As the (second) discharge is forcedly caused to occur by applying the voltage Vx1+Vβ1 and the voltage Vx1+Vβ2 to the odd-numbered line and the even-numbered line, respectively, in the present embodiment, the discharge is caused to occur without fail, and as the applied pulse is an obtuse (wave-shaped) pulse, the discharge is weak and contrast is not deteriorated.

Moreover, in the present embodiment, the reached potential −Vβ1 of the odd-numbered Y electrode at the end of the second discharge is set to be higher than the (address) pulse potential −VSC1 in the address period by a voltage Vα(>0), and the reached potential −Vβ2 of the even-numbered Y electrode at the end of the second discharge is set to be higher than the (address) pulse potential −VSC2 in the address period by the voltage Vα(>0), respectively, so that stable address discharges can be caused to occur.

The intensity of the second discharge can be controlled by the value of the voltage Vα, and the smaller the voltage Vα, the stronger (greater) the discharge intensity.

As the voltages VSC1 and VSC2 to be applied to the Y electrodes (Y1 and Y3, and Y2 and Y4) in the odd-numbered lines and the even-numbered lines in the subsequent first half and the second half of the address period is set so that VSC1<VSC2, the relationship between the applied voltages (values) of each electrode during the reset period is as follows.

$$V\beta1<V\beta2$$

$$V\beta1=VSC1-V\alpha$$

$$V\beta2=VSC2-V\alpha$$

$$Vx1+V\beta1=Vx2+V\beta2$$

From above, Vx1>Vx2, Vx1+VSC1=Vx2+VSC2.

The resetting in the reset period is completed as described above.

Next, selective address discharges are caused to occur to turn on or off the (display) cells according to the display data, in the address period. The address period is divided into the first half of the address period and the second half of the address period, and writing (addressing) of the selected cells in the odd-numbered lines L1, L3, . . . , is performed in the first half of the address period and the writing (addressing) of the selected cells in the even-numbered lines L2, L4, . . . , is performed in the second half of the address period.

First, in the writing (addressing) in the first half of the address period, the pulse having the voltage Vx1 is applied to the odd-numbered X electrodes X1 and X3 from the odd-numbered X sustain circuit 13*a*, the voltage 0V is applied to the even-numbered X electrodes X2 and X4 from the even-numbered X sustain circuit 13*b*, and the (scan) pulse having the voltage −VSC1 is applied to the odd-numbered Y electrodes Y1 and Y3 from the scan driver 15. At this time, the voltage 0V is applied to the even-numbered Y electrodes Y2 and Y3 (from the scan driver 15). In concurrence with this, the (address) pulse having the voltage Va is selectively applied to the address electrode from the address driver 12 and the first discharge is caused to occur between the address electrode and the Y electrode (between the address electrode and the Y1 electrode, and between the address electrode and the Y3 electrode) in the selected cells in the odd-numbered lines to be lit. Next, with this discharge serving as a priming, the second discharge is immediately caused to occur between the X electrode and the Y electrode (between the X1 electrode and the Y1 electrode, and between the X3 electrode and the Y3 electrode). During this time, the voltage Vx1 is being applied to the odd-numbered X electrodes X1 and X3 and the voltage 0V is being applied to the even-numbered X electrodes X2 and X4, therefore, the (second) discharge is caused to occur in the selected cells in the lines (odd-numbered lines) to which the voltage Vx1 is being applied. In this way, the wall discharges needed to start the sustain discharge are formed on (in the vicinity of) the X electrode and the Y electrode (between the X1 electrode and the Y1 electrode, and between the X3 electrode and the Y3 electrode) in the selected cells in the odd-numbered lines. When these actions are performed as far as the last odd-numbered Y electrode, the writing (addressing) of the selected cells in the Y1, Y3, . . . electrodes in the odd-numbered display lines (odd-numbered lines L1, L3, . . . , ) is completed.

Next, in the writing (addressing) in the second half of the address period, the pulse having the voltage Vx2 is applied to the even-numbered X electrodes X2 and X4 from the even-numbered X sustain circuit 13*a*, the voltage 0V is applied to the odd-numbered X electrodes X1 and X3 from the odd-numbered sustain circuit 13*a*, and the (scan) pulse having the voltage −VSC2 is applied to the even-numbered Y electrodes Y2 and Y4 from the scan driver 15. At this time, the voltage 0V is applied to the odd-numbered Y electrodes Y1 and Y3 (from the scan driver 15). In concurrence with this, the address pulse having the voltage Va is applied selectively to the address electrode from the address driver 12. In this way, the writing (addressing) of the selected cells in the even-numbered Y electrodes Y2, Y4, . . . , in the even-numbered display lines (even-numbered lines L2, L4, . . . , ) is performed (as described above).

As described above, the writing (addressing) of the selected cells in all of the display lines L1, L2, L3, L4, . . . , (odd-numbered and even-numbered lines) is completed in the first half of the address period and the second half of the address period.

In the present embodiment, the voltage VSC2 to be applied to the Y2 and Y4 electrodes during the scanning of the even-numbered lines L2 and L4 in the second half of the address period is set to a voltage larger than the voltage VSC1 to be applied to the Y1 and Y3 electrodes during the scanning of the odd-numbered lines L1 and L3 in the first half of the address period. In other words, the voltage (value) to be applied to each electrode is specified so that the voltage Va+VSC2 between the address electrode and the Y electrode (between the address electrode and the Y2 electrode, and between the address electrode and the Y4 electrode) in the selected cells in the even-numbered lines in the second half of the address period is larger than the voltage Va+VSC1 between the address electrode and the Y electrode (between the address electrode and the Y1 electrode, and between the address electrode and the Y3 electrode) in the selected cells in the odd-numbered lines in the first half of the address period (Va+VSC1<Va+VSC2). Due to this, in the selected cells in the even-numbered line, a strong discharge due to the voltage Va+VSC2 is caused to occur between the address electrode and the Y electrode (Y2 and Y4) and a larger amount of charged particles is generated compared to that generated by a discharge due to the voltage Va+VSC1 between the address electrode and the Y electrode (Y1 and Y3) in the odd-numbered lines, therefore, the discharge start voltage in the selected cells in the even-numbered lines is lowered to a value smaller than that in the selected cells in the odd-numbered lines due to these charged particles. As a result, the following (address) discharge (the above-mentioned second discharge) between the X electrode and the Y electrode (between the X2 electrode and the Y2 electrode, and between the X4 electrode and the Y4 electrode) in the selected cells in the even-numbered lines, that is, the discharge between the X electrode and the Y electrode (between the X2 electrode and the Y2 electrode, and between the X4 electrode and the Y4 electrode) in the selected cells in the even-numbered lines to which the voltage Vx2+VSC2 is applied, which (the value of which) is equivalent to the voltage Vx1+VSC1 between the X electrode and the Y electrode (between the X1 electrode and the Y1 electrode, and between the X3 electrode and the Y3 electrode) in the odd-lined lines in the first half of the address period, can be stably caused to occur due to the voltage Vx2+VSC2 (=Vx1+VSC1), the scale of which being equivalent to that of a discharge due to the voltage Vx1+VSC1 (=Vx2+VSC2) between the X electrode and the Y electrode (between the X1 electrode and the Y1 electrode, and between the X3 electrode and the Y3 electrode) in the odd-numbered lines. In other words, even if the erroneous discharge described in FIG. 9 is caused to occur, an address discharge can be caused to occur without fail in the selected cells in the even-numbered lines in the second half of the address period.

Moreover, as described above, by setting the scale of the discharge (due to the voltage Vx1+VSC1) between the X electrode and the Y electrode (the above-mentioned second discharge) in each selected cell in the odd-numbered lines in the first half of the address period equal to the discharge (due to the voltage Vx2+VSC2) between the X electrode and the Y electrode (the above-mentioned second discharge) in the even-numbered lines in the second half of the address period, it is possible to keep the wall charges needed for the subsequent sustain discharge in the selected cells in the odd-numbered lines at the end of the first half of the address period equal to that in the even-numbered lines at the end of the second half of the address period. As a result, the sustain discharge of the same scale is caused to occur without fail in the selected cells in the odd-numbered lines and the even-numbered lines in the subsequent sustain discharge period, and the sustain discharge can be stably caused to occur in the selected cells in all of the display lines (odd-numbered lines and even-numbered lines).

The relationship between the voltages to be applied to each X electrode, Y electrode and address electrode in the odd-numbered lines (L1 and L3) and the even-numbered lines (L2 and L4) in the first half and the second half of the address periods is obtained as follows from the above-mentioned settings Vx>Vx2, VSC1<VSC2, $$Va+VSC1<Va+VSC2$$

$$Vx1+VSC1=Vx2+VSC2$$

Next, in the sustain discharge period, the sustain discharge pulse having the alternating voltage Vs is applied alternately to every X electrode and Y electrode, and the sustain discharge is repeated the specified number of times in an arbitrary subfield in the selected cells in the display lines (the odd-numbered lines and even-numbered lines) in which the address discharge has been caused to occur in the first half and second half of the address periods.

With the above-mentioned series of actions or processes, the driving of a subfield is completed.

Next, the second embodiment of the present invention is described below.

Figure 11:
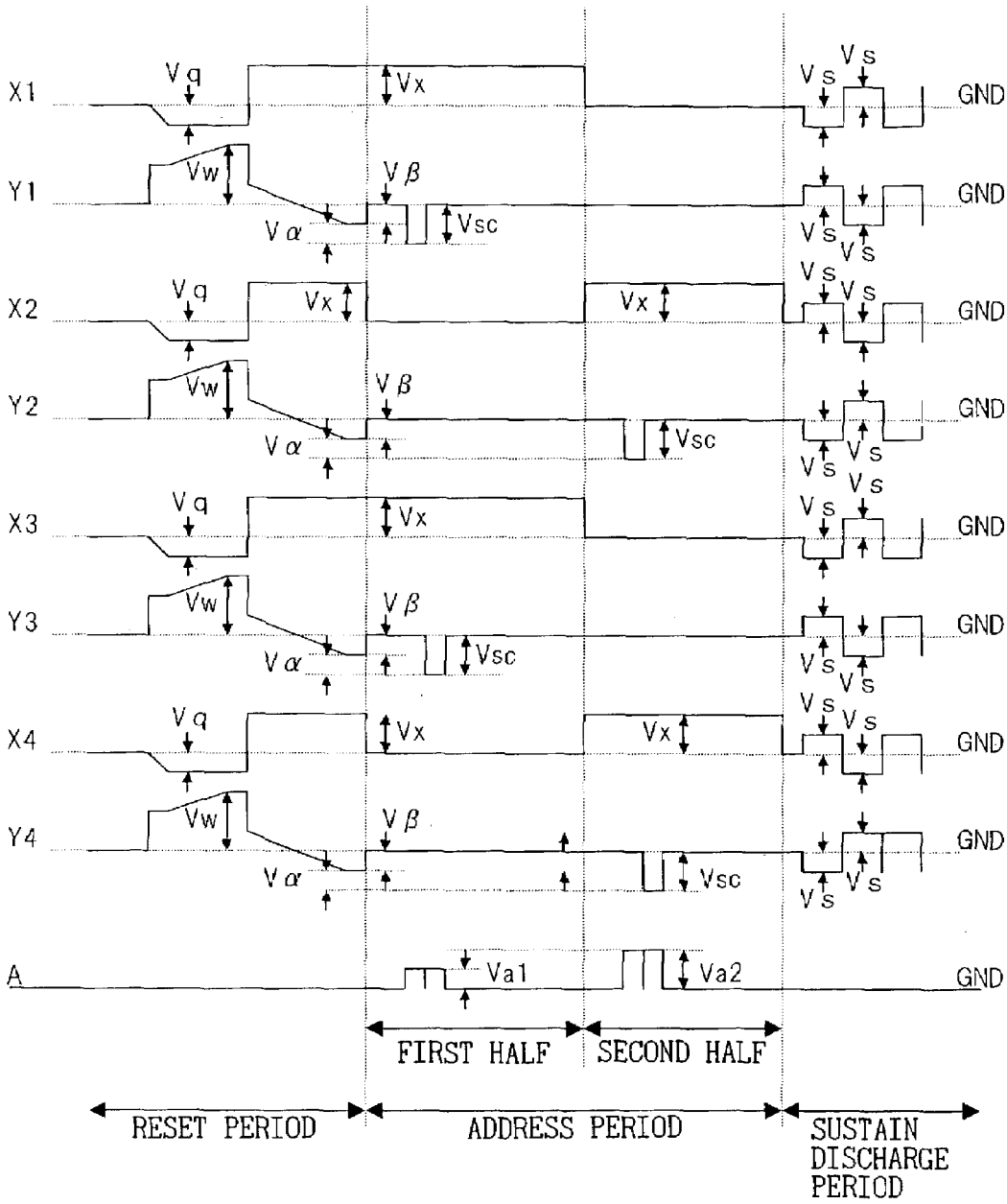
FIG. 11 shows waveforms that illustrate a method for driving an AC-driven PDP in a second embodiment of the present invention.

FIG. 11 is a diagram that shows the method for driving an AC-driven PDP in the second embodiment of the present invention. In the following description, the same symbols are assigned to the components that are the same as those described above, and only the difference is described, with just reference to those components.

As is obvious from the comparison between FIG. 11 an FIG. 10, the driving method in the present embodiment differs from that in the first embodiment in that the voltage applied to each X electrode and Y electrode in the odd-numbered lines and even-numbered lines in the reset period (first half and second half) and address period is identical (value), and the voltage Va2 applied to the address electrode during the scanning of the even-numbered lines in the second half of the address period is set to a value larger than the voltage Va1 applied to the address electrode during the scanning of the odd-numbered lines in the first half of the address period (Va1<Va2). Others are the same as those in the first embodiment.

As described above, in the driving method in the first embodiment, the applied voltage Vβ2 of the Y electrode (Y2 and Y4) in the even-numbered lines in the reset action in the second half of the reset period is set to a value larger than the applied voltage Vβ1 (negative polarity) of the Y electrode (Y1 and Y3) in the odd-numbered lines (Vβ1<Vβ2), and the applied voltage (voltage VSC2) (negative polarity) of the Y electrode during the scanning of the even-numbered lines in the subsequent second half of the address period is set to a value larger than the applied voltage (voltage VSC1) (negative polarity) of the Y electrode during the scanning of the odd-numbered lines in the first half of the address period (VSC1<VSC2). Due to this, it is possible to set the voltage Va+VSC2 between the address electrode and the Y electrode (between the address electrode and the Y2 electrode, and between the address electrode and the Y4 electrode) in the discharge cells in the even-numbered lines to a voltage larger than the voltage Va+VSC1 between the address electrode and the Y electrode (between the address electrode and the Y1 electrode, and between the address electrode and the Y3 electrode) in the discharge cells in the odd-numbered lines. At this time, the voltage Vx1+VSC1 between the X electrode and the Y electrode (between the X1 electrode and the Y1 electrode, and between the X3 electrode and the Y3 electrode) in the selected cells in the odd-numbered lines and the voltage Vx2+VSC2 between the X electrode and the Y electrode (between the X2 electrode and the Y2 electrode, and between the X4 electrode and the Y4 electrode) in the selected cells in the even-numbered lines are adjusted and set so as to be equal to each other.

Contrary to this, as shown in FIG. 11, in the present embodiment, by setting the final (reached) voltages of the (negative polarity) pulse to be applied to the odd-numbered Y electrode (Y1 and Y3) and the even-numbered Y electrode (Y2 and Y4) in the reset action in the second half of the reset period to the same voltage Vβ, the voltage applied to the X electrode (X1 and X3) that is one of a pair, performing display together with the Y electrode (Y1 and Y3) in the odd-numbered lines and the voltage applied to the X electrode (X2 and X4) that is one of a pair, performing display together with the Y electrode (Y2 and Y4) in the even-numbered lines in the reset action in the second half of the reset period are set to the same voltage (value) Vx, and the voltage applied to the X electrode (X1 and X3) during the scanning of the odd-numbered lines and the applied voltage to the X electrode (X2 and X4) during the scanning of the even-numbered lines in the subsequent first half and second half of the address periods are also set to the same voltage Vx. Due to these settings, the voltage applied to the Y electrode (Y1 and Y3) that is one of a pair, performing display together with the X electrode (X1 and X3) in the odd-numbered lines is set to the voltage VSC, which (the value of which) is the same as the voltage applied to the Y electrode (Y2 and Y4) that is one of a pair, performing display together with the X electrode (X2 and X4) in the even-numbered lines.

At this time, the (selective) voltage Va2 applied to the address electrode during the scanning of the even-numbered lines (L2 and L4) in the second half of the address period is set to a voltage larger than the (selective) voltage Va1 applied to the address electrode during the scanning of the odd-numbered lines (L1 and L3) in the first half of the address period (Va1<Va2). Due to this, the voltage Va2+VSC between the address electrode and the Y electrode (between the address electrode and the Y2 electrode, and between the address electrode and the Y4 electrode) in the selected cells in the even-numbered lines becomes larger than the voltage Va1+VSC between the address electrode and the Y electrode (between the address electrode and the Y1 electrode, and between the address electrode and the Y3 electrode) in the selected cells in the odd-numbered lines (Va1+VSC<Va2+VSC). As a result, as is similar to (the effects of) the first embodiment described above, in the selected cells in the even-numbered lines (L2 and L4) in the second half of the address period, a strong discharge due to the voltage Va2+VSC between the address electrode and the Y electrode (between the address electrode and the Y2 electrode, and between the address electrode and the Y4 electrode) is caused to occur, a larger amount of charged particles is generated compared to that generated by a discharge due to the voltage VSC+Va1 between the address electrode and the Y electrode (between the address electrode and the Y1 electrode, and between the address electrode and the Y3 electrode) in the selected cells in the odd-numbered lines (L1 and L3) in the first half of the address period, therefore, the discharge start voltage in the selected cells in the even-numbered lines (L2 and L4) is lowered to a voltage smaller than that in the selected cells in the odd-numbered lines in the second half of the address period because of these charged particles. Due to this, the following (address) discharge (the above-mentioned second discharge) between the X electrode and the Y electrode (between the X2 electrode and the Y2 electrode, and between the X4 electrode and the Y4 electrode) in the selected cells in the even-numbered lines, that is, the discharge between the X electrode and the Y electrode (between the X2 electrode and the Y2 electrode, and between the X4 electrode and the Y4 electrode) in the selected cells in the even-numbered lines to which the voltage is applied, which (the value of which) is equivalent to the voltage Vx+VSC between the X electrode and the Y electrode (between the X1 electrode and the Y1 electrode, and between the X3 electrode and the Y3 electrode) in the odd-lined lines in the first half of the address period, can be stably caused to occur, the scale of which being equivalent to that of a discharge due to the voltage Vx+VSC between the X electrode and the Y electrode (between the X1 electrode and the Y1 electrode, and between the X3 electrode and the Y3 electrode).

Moreover, as described above, by setting the scale of the (above-mentioned second) discharge (due to the common voltage Vx+VSC) between the X electrode and the Y electrode in each selected cell in the odd-numbered lines and the even-numbered lines in the first half and the second half of the address periods equal to each other, it is possible to keep the wall charges needed for the subsequent sustain discharge in each selected cell in the odd-numbered lines at the end of the first half of the address period equal to that in the even-numbered lines at the end of the second half of the address period. As a result, the sustain discharge of the same scale is caused to occur without fail in the selected cells in the odd-numbered lines and the even-numbered lines in the subsequent sustain discharge period, and the sustain discharge can be stably caused to occur in the selected cells in all of the display lines (odd-numbered lines and even-numbered lines).

The method for driving a PDP of the present invention can also be applied to a PDP employing a method in which light is emitted for display between every pair of adjacent display electrodes (this method is called the ALIS method and, as the structure, the drive circuits, the subfield structure, and the like of the ALIS method are disclosed in U.S. Pat. No. 2,801,893, a description will not given here).

As described above, according to the present invention, when the address period is divided into the first half and the second half and the scanning of the display lines are performed for every other display line, the effects can be obtained that the address discharge in the second half of the address period and the sustain discharge in the sustain discharge period can be stably caused to occur without fail, by changing the potential difference between the address electrode and the scan electrode (Y electrode) during the scanning of the odd-numbered lines in the first half of the address period from that during the scanning of the even-numbered lines in the second half of the address period, and simultaneously by setting the potential difference between the sustain electrode (X electrode) and the scan electrode (Y electrode) during the scanning of the odd-numbered lines in the first half of the address period equal to that during the scanning of the even-numbered lines in the second half of the address period.

We claim:

1. A method for driving a plasma display panel in which plural first and second electrodes in parallel to each other are arranged adjacently by turns, and plural third electrodes are arranged in a direction perpendicular to the first and second electrodes, and discharge cells defined at crossings of each electrode are arranged in a matrix, comprising:

a reset period in which a wall charge distribution of wall charges in the plural discharge cells is initialized;

an address period in which distribution of wall charges according to display data is formed by address discharges, consisting of a first half of the address period in which scan pulses are sequentially applied to electrodes of one group of odd-numbered second electrodes and one group of even-numbered second electrodes, and address pulses according to the display data are applied to the third electrodes, and a second half of the address period in which scan pulses are sequentially applied to electrodes of the other of odd-numbered second electrodes and the even-numbered second electrodes, and address pulses according to the display data are applied to the third electrodes; and a sustain discharge period in which sustain discharges are caused to occur according to the distribution of wall charges formed in the address period;

wherein a potential difference between a second electrode of the other of the odd numbered second electrodes and a third electrode, which causes the address discharge in the second half of the address period is set to a value larger than a potential difference between a second electrode of the odd-numbered second electrodes group and the even-numbered second electrodes group and a third electrode, which causes the address discharge in the first half of the address period.

2. The method for driving a plasma display panel, as set forth in claim 1, wherein a potential of the scan pulses applied to the second electrode is changed in the first half and the second half of the address period.

3. The method for driving a plasma display panel, as set forth in claim 1, wherein a potential of the address pulses applied to the third electrode is changed in the first half and the second half of the address period.

4. The method for driving a plasma display panel, as set forth in claim 1, wherein a potential difference between the first electrode and the second electrode when the scan pulses are applied in the first half of the address period is substantially the same as a potential difference between the first and the second electrode when the scan pulses are applied in the second half of the address period.

5. The method for driving a plasma display panel, as set forth in claim 2, wherein a potential difference between the first electrode and the second electrode when the scan pulses are applied in the first half of the address period is substantially the same as a potential difference between the first and the second electrode when the scan pulses are applied in the second half of the address period.

6. The method for driving a plasma display panel, as set forth in claim 3, wherein a potential difference between the first electrode and the second electrode when the scan pulses are applied in the first half of the address period is substantially the same as a potential difference between the first electrode and the second electrode when the scan pulses are applied in the second half of the address period.

7. The method for driving a plasma display panel, as set forth in claim 6, wherein the potential difference between the first electrode and the second electrode when the scan pulses are not applied in the first half of the address period is substantially the same as the potential difference between the first electrode and the second electrode when the scan pulses are not applied in the second half of the address period.

8. A method for driving a plasma display panel in which plural sustain electrodes are parallel and interleaved with scan electrodes, and address electrodes are arranged in perpendicular to the sustain and the scan electrodes, so that discharges occur at crossings of electrodes, comprising:

generating a wall charge distribution according to display data during an address period, by sequentially applying scan pulses to a first group of scan electrodes and first address pulses to address electrodes during a first half of the address period, and sequentially applying scan pulses to a second group of electrodes and second address pulses to address electrodes during a second half of the address period, wherein the first address pulses have a different potential than the second address pulses, and a potential difference between a second electrode and an address electrode in the first half of the address period is larger than a potential difference between a first electrode and an address electrode in the second half of the address period.

* * * * *

UNITED STATES PATENT AND TRADEMARK OFFICE

CERTIFICATE OF CORRECTION

PATENT NO. : 7,375,702 B2
APPLICATION NO. : 10/355084
DATED : May 20, 2008
INVENTOR(S) : Atsushi Yokoyama et al.

It is certified that error appears in the above-identified patent and that said Letters Patent is hereby corrected as shown below:

Title Page, (73) (Assignee), Line 2, change “Kawasak” to --Kawasaki--.

Signed and Sealed this

Seventh Day of October, 2008

JON W. DUDAS
*Director of the United States Patent and Trademark Office*